US005303436A

United States Patent [19]

Dinsmoor, III et al.

[11] Patent Number: 5,303,436

[45] Date of Patent: Apr. 19, 1994

[54] ANTI-DECUBING MATTRESS PAD

[75] Inventors: John C. Dinsmoor, III, Westminster; Grant C. Denton; Eric C. Jay, both of Boulder; Richard R. Runkles, Englewood, all of Colo.

[73] Assignee: Jay Medical, Ltd., Boulder, Colo.

[21] Appl. No.: 4,137

[22] Filed: Jan. 13, 1993

Related U.S. Application Data

[62] Division of Ser. No. 756,320, Sep. 6, 1991, Pat. No. 5,201,780.

[51] Int. Cl.[5] ..... A47C 27/14; A47C 27/18

[52] U.S. Cl. ..... 5/481; 5/464

[58] Field of Search ..... 5/481, 464, 448, 653, 5/900.5; 297/DIG. 1

[56] References Cited

U.S. PATENT DOCUMENTS

| | | | |
|---|---|---|---|
| 2,814,053 | 11/1957 | Sevcik | 5/455 |
| 3,605,145 | 9/1971 | Graebe | 5/455 |
| 3,893,198 | 7/1975 | Blair | 5/481 |
| 3,968,530 | 7/1976 | Dyson | 5/450 |
| 4,110,881 | 9/1978 | Thompson | 5/481 |
| 4,483,029 | 11/1984 | Paul | 5/453 |
| 4,485,505 | 12/1984 | Paul | 5/453 |
| 4,498,205 | 2/1985 | Hino | 5/449 |
| 4,572,174 | 2/1986 | Eilender | 5/485 |
| 4,588,229 | 5/1986 | Jay | 5/654 |
| 4,660,238 | 4/1987 | Jay | 5/451 |
| 4,698,864 | 10/1987 | Graebe | 5/455 |
| 4,713,854 | 12/1987 | Graebe | 5/481 |
| 4,726,624 | 2/1988 | Jay | 5/654 |
| 4,728,551 | 3/1988 | Jay | 5/450 |
| 4,842,330 | 6/1989 | Jay | 297/DIG. 3 |
| 4,866,800 | 9/1989 | Bedford | 5/481 |
| 4,901,387 | 2/1990 | Luke | 5/481 |
| 4,959,059 | 9/1990 | Eilender et al. | 5/485 |
| 5,018,790 | 5/1991 | Jay | 5/654 |
| 5,025,519 | 6/1991 | Spann et al. | 5/464 |

FOREIGN PATENT DOCUMENTS

| | | | |
|---|---|---|---|
| 526407 | 5/1955 | Italy | 5/481 |
| 1261475 | 1/1972 | United Kingdom | 5/455 |
| 1559851 | 1/1980 | United Kingdom | 5/464 |

OTHER PUBLICATIONS

Brochure of Lumex, Inc., 1989.
Brochure of Lotus, 1990.
Brochure of Medifloat, Inc., 1990.
Brochure of KCI, 1989.
Brochure of Clinicare Systems, Inc., 1990.
Brochure of Baxter, 1989.
Brochure of Aquatherm Products Corp., 1990.

*Primary Examiner*—Alexander Grosz
*Attorney, Agent, or Firm*—W. Scott Carson

[57] ABSTRACT

A mattress pad primarily intended for use with a standard hospital bed frame to reduce the development of decubitus ulcers or bed sores in patients using the pad. The pad is multi-layered and includes a cover or casing containing interior strata of a plastic film layer atop a fluid bladder layer supported on an underlying layer of foam. The pad is specially designed to reduce lateral and normal pressures and forces on the patient which can lead to the development of such ulcers. The reduction of the lateral shearing forces is accomplished in a number of ways including by oversizing the plastic film layer and fluid bladder layer on the underlying layer of foam and by positioning microbeads between the plastic film layer and fluid bladder layer to dramatically reduce the frictional drag or lateral shearing forces between the layers. Similarly, the normal pressures and forces are reduced and controlled in a number of manners including oversizing, modifying the configuration, filling, and size of the discrete fluid pouches of the fluid bladder layer, and varying the spring characteristics of the support columns in the underlying foam layer by hollowing them out to differing degrees, adjusting their spacing, and selectively tying adjacent columns together.

18 Claims, 10 Drawing Sheets

ANTI-DECUBING MATTRESS PAD

This is a divisional of application Ser. No. 756,320, filed Sep. 6, 1991, now U.S. Pat. No. 5,201,780.

BACKGROUND OF THE INVENTION

1. Field of The Invention

This invention relates to the field of mattress and cushion pads primarily intended for hospital use to reduce the development of decubitus ulcers in patients using the pads.

2. Discussion Of The Background

Decubitus ulcers, commonly referred to as bed or pressure sores, are a major health concern for patients that become bed or chair bound for prolonged periods of time. They are also frequent complications for burn victims and tall, thin patients and other patients with particularly bony protuberances. The ulcers generally develop at such bony protuberances as well as other relatively bony areas of the patient's body including the trochanteric (hip) area, scapula (shoulder blade) area, spinal area, and coccyx (tailbone) area where relatively little flesh is present and blood circulation is often poor.

Factors contributing to the development of the decubitus ulcers are numerous including the general overall condition of the patient's skin and underlying tissue; however, forces generated on the patient's body by the mattress pad or other support are also critical. These forces include both normal and lateral or shearing forces. Reduction of such forces has been attempted and accomplished in a variety of product designs with varying degrees of success and widely varying costs. Such product designs extend the gambit from, for example, standard hospital mattresses on one end to more exotic and expensive designs such as fluidized, specialty beds on the other.

Standard hospital mattresses and cushions are generally not considered as anti-decubitus products and, in fact, are often the primary cause of the decubitus ulcers in the patients using them. While certainly providing a degree of comfort over a limited time, conventional hospital mattresses commonly create pressure points and localized areas of relatively high, normal forces on the patient's body that may result directly in decubitus ulcers. Such normal pressures and forces when excessive or prolonged can cause localized occlusion of capillary blood flow depriving the skin and underlying tissue of needed oxygen and nutrition. Conventional mattresses can also offer significant resistance to lateral movement of the patient as he or she rolls over or otherwise moves or is moved across or along the mattress. Such resistance can create substantial lateral shear forces which may also cause occlusion of the capillary blood flow as well as cause direct structural failure or rupture of the skin and underlying tissue.

To improve the anti-decubitus properties of standard hospital mattresses, overlays are often used as a first measure. Such overlays, for example, may include convoluted foam pads of various thicknesses and densities which are quite common and inexpensive. The foam overlays generally are relatively thin and do a marginal job of reducing pressure points and high normal forces but have no mechanism for reducing lateral shear forces. Inflatable overlays are also widely used to reduce normal forces but like foam ones, they are relatively thin and have no mechanism for reducing shear forces. They are also prone to puncture failure and leakage and like most overlays, are usually difficult to clean and sanitize. Consequently, they are for the most part not reusable from one patient to the next. Inflatable overlays typically consist of a sealed vinyl bladder that is inflated manually or by an air pump. The more sophisticated and expensive models have a plurality of air chambers within the sealed bladder wherein adjacent chambers are alternately inflated and deflated (e.g., every 5–10 minutes). This serves to vary the support to areas of the patient's body to prevent any long term development of pressure points and the accompanying occlusion of blood flow that can lead to the development of the decubitus ulcers. However, in addition to the potential failure by puncture or leakage, the performance of such inflatable overlays depends greatly upon proper initial and continuing operation particularly in regard to correct inflation with respect to each patient's size, weight, and position.

Devices that are designed to replace the conventional hospital mattress altogether but still use the existing hospital bed frame are commonly referred to as "mattress replacements." Such replacements are normally categorized into two groups (i.e., dynamic and static or passive). Dynamic ones as the name implies are operationally active and require an external power source. In a large number of them, they employ pneumatic technology including some basic concepts used in inflatable overlays as discussed above (e.g., alternating inflating-/deflating of adjacent air chambers). However, because of the use of external power sources, such pneumatic mattress replacements can also employ more advanced and complicated features such as isolating individual air chambers or zones and selectively controlling and adjusting the pressure in them. In this manner, pressure can be reduced, for example, in those chambers or zones where the risk of tissue breakdown is relatively high while pressure can be increased in the remaining chambers or zones where the risk of sore development is relatively low. Still other pneumatic mattress replacements maintain and monitor air flow through the bladder to control moisture and temperature at the interface of the patient's body on the mattress. This is usually done in systems classified as low air loss ones meaning that there is a predetermined amount of "air loss" or air flow through the inflated mattress. The air flow is then monitored and controlled for the desired moisture content and temperature. Dynamic mattress replacements often retail in the range of $2,000–$6,000 and are commonly leased or rented to the user or hospital because of the maintenance and repair requirements inherent in any such active systems.

Static or passive mattress replacements require no external power to operate and rely on a combination of materials and mechanical elements to achieve reduced normal or interface pressure between the patient's body and the mattress. The performance of static mattress replacements is generally not as high as the dynamic ones; however, they are very popular due to their reliability, maintainability, and relatively low cost ($500–$1,000). They are also for the most part very user friendly in the sense that there is very little if any need for the user to monitor or adjust any controls or other settings. Examples of static or passive systems would be simple waterbeds as well as designs that employ specially configured foam components or bladders filled with gels, air, or other fluids. In addition to their relatively low cost, the primary desirability of static or passive mattress replacements over the dynamic ones is that they do not have any externally powered components (with their inherent degree of additional complexity, cost, and maintenance).

Still other products that are designed to reduce the development of decubitus ulcers include specialty beds. Such specialty beds are typically integrated with their own bed frame and control systems that allow the user to adjust or control a variety of features. There are several types of such specialty beds including low air loss beds, fluidized bead beds, and spinal cord injury beds. The low air loss beds include many of the features of low air loss, replacement mattresses discussed above but generally on a more sophisticated level. Like the mattress replacement, low air loss, specialty beds commonly include a series of inflatable, adjacent chambers or zones which can be selectively inflated or deflated to obtain the desired support. Additionally, the control systems on such low air loss, specialty beds may regulate the air pressure to each individual chamber or zone of chambers. They may also monitor and control the moisture and temperature of the air that circulates through the air chambers or zones. In one common mode of operation, moisture from the patient's body is wicked away from the patient through the surface material of the bed into the chambers or zones where it is then evaporated and subsequently removed or exhausted by the circulation of fresh air through the system. Some low air loss, specialty beds also employ the alternating support concept discussed above with the more sophisticated ones even allowing the specific placement of shaped or profiled pillows which enable positioning and immobilization of the patient as desired. Still others include a turning feature which rotates the entire support surface and patient about the longitudinal axis of the bed. Understandably, the degree of complexity of these specialty beds inherently demands extensive maintenance and service requirements. Nevertheless, the overall performance is good and many victims of pressure sores or decubitus ulcers are placed on these types of beds for cure. Unfortunately, the high initial cost of these specialty beds (e.g., $10,000 to $40,000) as well as the high rental or lease rate (e.g., $80–$125 per day) limit their wide usage.

Of the specialty beds, perhaps the most effective are the fluidized bead beds. Such beds are considerably different from most other support systems in that the patient is supported by approximately 1200–1500 pounds of silica beads which are fluidized by a continuous flow of air from underneath the patient. A filter sheet separates the patient from the beads but allows the flow of air to pass through. This type of surface provides excellent pressure relief (i.e., virtually no normal pressure points) and also offers significantly reduced resistance (i.e., very low lateral or shearing force) to the patient's body as he or she moves or is moved across or along the bed. Nevertheless, fluidized bead beds do have several distinct disadvantages in addition to cost and complexity including the fact that they must remain in a horizontal position and they can cause severe dehydration in the patient due to the constant air flow past the patient's body. Also, patient transfers to and from the bed are often complicated due to the tub-like structure that contains the fluidized beads. Further, the entire volume of the beads must be cleaned and reprocessed after each patient's use.

With the above in mind, the anti-decubitus mattress pad of the present invention was developed. With it, the reduction of both normal and lateral forces and pressures on the patient's body such as currently achieved for the most part only in the higher priced and more complex specialty beds can now be offered in a less expensive, static, reusable mattress replacement design.

SUMMARY OF THE INVENTION

This invention involves a mattress pad primarily intended for use with a standard hospital bed frame to reduce the development of decubitus ulcers or bed sores in patients using the pad. The pad is multi-layered and includes a cover or casing containing interior strata of a plastic film layer atop a fluid bladder layer supported on an underlying layer of foam.

The mattress pad of the present invention is specially designed to reduce lateral and normal pressures and forces on the patient which can lead to the development of such ulcers. The reduction of the lateral shearing forces is accomplished in a number of ways. However, it is primarily achieved by oversizing the plastic film layer and fluid bladder layer on the underlying layer of foam and by positioning microbeads between the plastic film layer and fluid bladder layer to dramatically reduce the frictional drag or lateral shearing forces between the layers. Similarly, the normal pressures and forces are reduced and controlled in a number of manners including oversizing, modifying the configuration, filling, and size of the discrete fluid pouches of the fluid bladder layer, and varying the spring characteristics of the support columns in the underlying foam layer by hollowing them out to differing degrees, adjusting their spacing, and selectively tying adjacent columns together. Other features of the pad are also included resulting in an anti-decubitus mattress pad that is effective, easily operated and maintained, and relatively inexpensive.

DETAILED DESCRIPTION OF THE PREFERRED EMBODIMENTS

Figure 1:
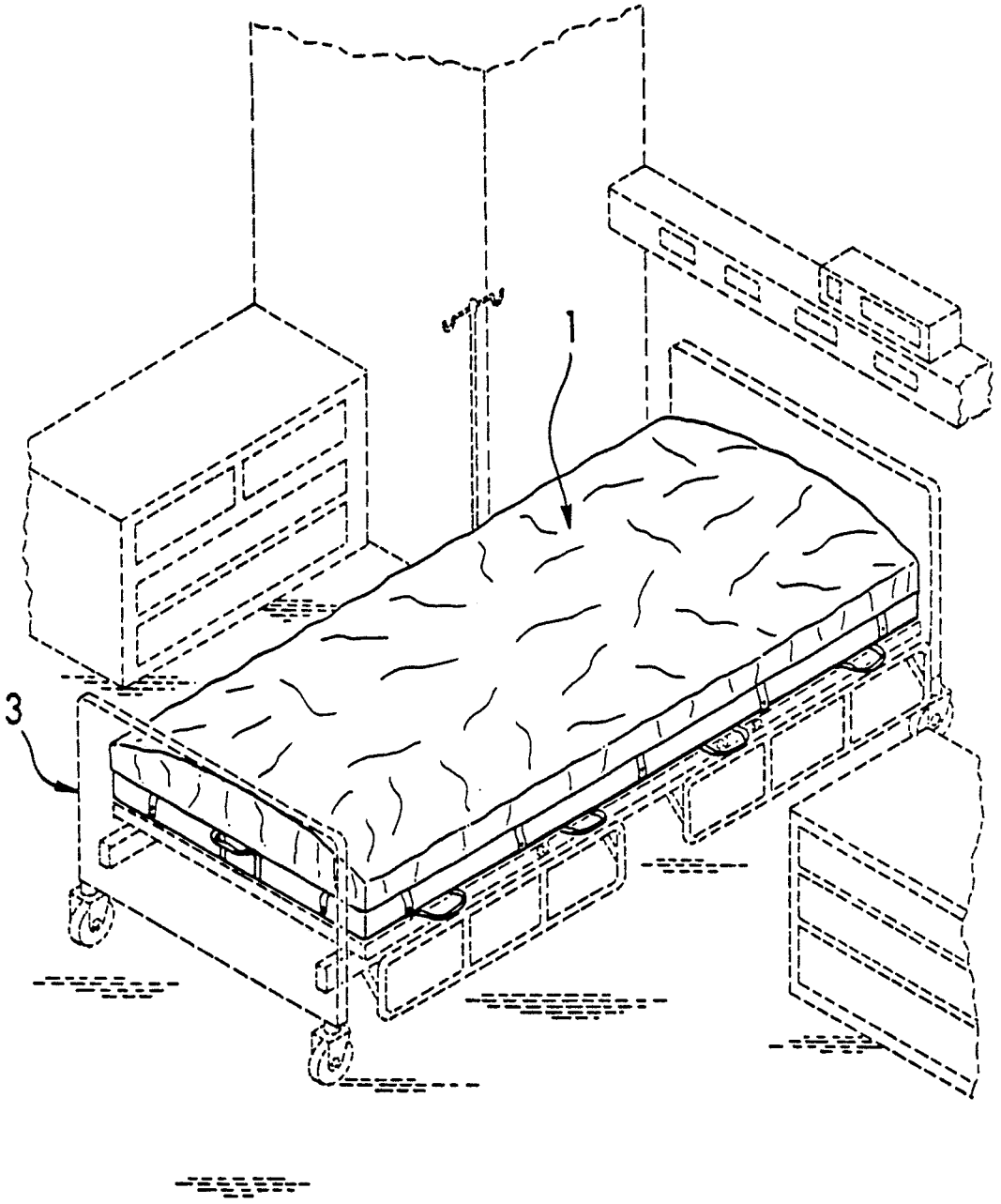
FIG. 1 illustrates the mattress pad of the present invention in use on a standard hospital bed frame.
Figures 2, 3:
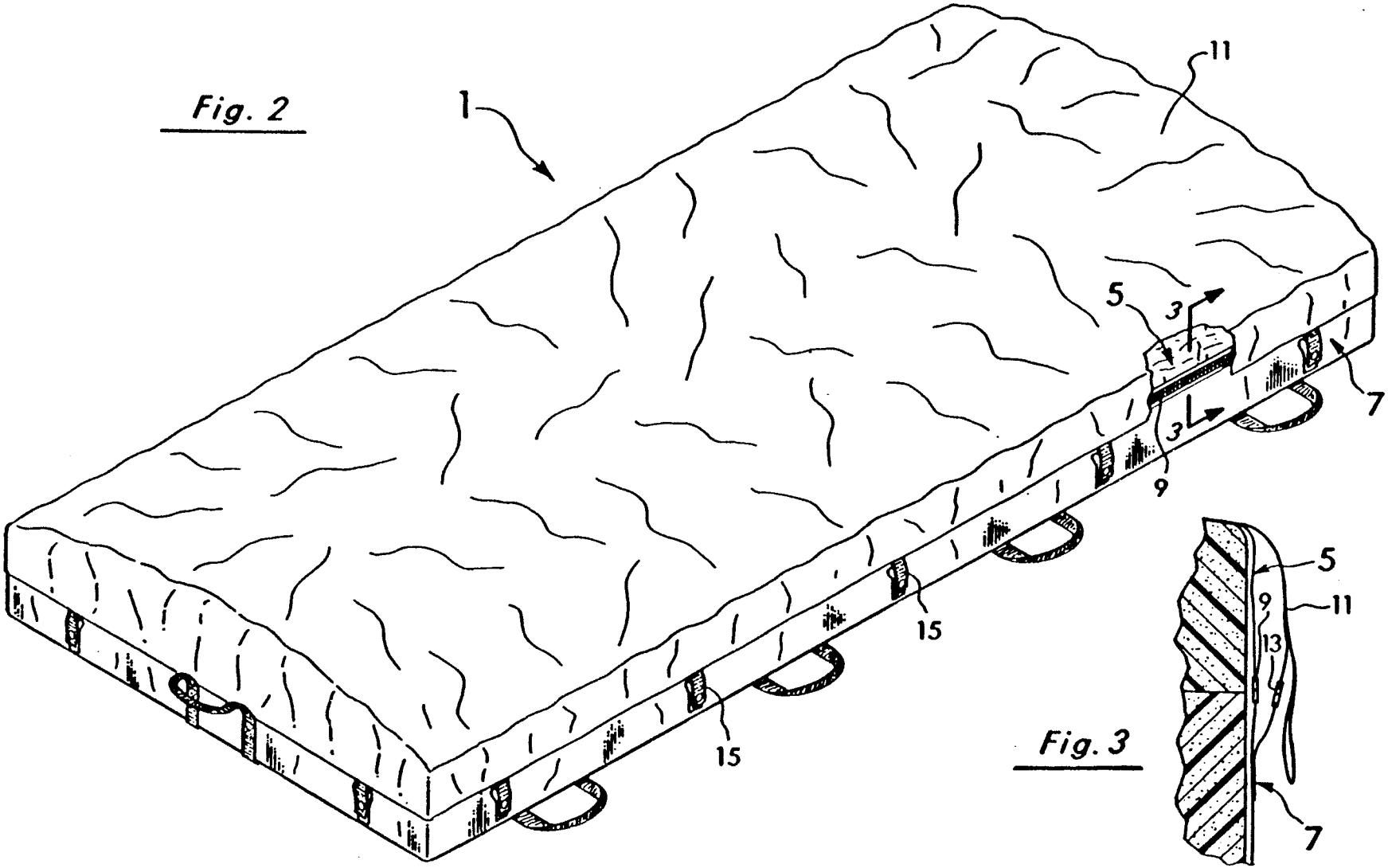
FIG. 2 is a perspective view of the assembled mattress pad.
FIG. 3 is a view taken along line 3—3 of FIG. 2.

As shown in FIG. 1, the mattress pad 1 of the present invention is primarily intended for use with a conventional hospital bed frame 3 as a retrofittable replacement for the standard hospital mattress. The pad 1 itself (see FIG. 2) preferably includes an external cover or casing with upper and lower halves 5 and 7 which are zipped together at 9. In the preferred embodiment, the upper half 5 also has a hospital sheet 11 on it which is attachable to the cover by a separate zipper arrangement 13 (see FIG. 3) or by the clips 15 of FIG. 2.

The pad 1 is multi-layered and in addition to the upper and lower halves 5 and 7 of the external cover, the pad 1 (see the exploded view of FIG. 4) includes a plastic film layer 17 which is positioned above a fluid bladder layer 19. Beneath the fluid bladder layer 19 is a foam layer 21 which includes a resilient, soft foam 23 centrally positioned in and peripherally supported by the perimeter support member 25 of a more rigid foam. Each of the layers 17, 19, and 21 is preferably divided into three longitudinal sections (i.e., foot, middle, and head sections). Each section (e.g., the foot section of layers 17A, 19A, and 21A on the left side in FIG. 4) can then be assembled as a unit separate and apart from the middle section of layers 17B, 19B, and 21B and the head section of layers 17C, 19C, and 21C. This sectionalizing is primarily done to make the mattress pad 1 easier to handle, ship, and store, particularly since the fluid bladder layers 19A, 19B, and 19C may weigh up to about 40 lbs. each. Additionally, because the pad 1 is sectionalized, the properties of the various sections as explained in more detail below can be varied as desired to customize the mattress pad 1 to the patient.

As discussed above, the mattress pad 1 is specially designed to reduce the development of decubitus ulcers in patients using the pad 1. To this aim, the individual layers as well as the relationships between and among the layers are specifically designed to offer the patient a mattress with a minimum of lateral shear forces as well as a minimum of normal pressures on the patient's body (e.g., upper back, buttocks, and upper thighs) where decubitus ulcers commonly develop.

Lateral Shear Forces—Glass Microbeads

The minimization of the lateral shear forces experienced by the patient as he or she rolls over or otherwise moves or is moved laterally across or along the pad 1 is accomplished by significantly reducing the frictional drag between the plastic film layer 17 and the fluid bladder layer 19 which is positioned beneath it. This is done not only by oversizing the layers 17 and 19 on the foam layer 21 (as explained in more detail below) but also by specifically enhancing the relative sliding movement between the layers 17 and 19 by inserting glass microbeads therebetween. The glass microbeads are preferably hollow, spherical beads made of glassy, siliceous, or ceramic materials with diameters on the order of about 10 to about 300 microns. They can also be made of phenolic, plastic, or similar materials. The gas-filled (e.g., air, nitrogen) microbeads maintain their closed, spherical shape in use and do not break under the weight of the patient on the mattress pad 1. Such low density microbeads have traditionally been used as filler or weight-reducing components in a number of applications including waxes, wax-oil mixtures, and gels (see U.S. Pat. No. 4,728,551). However, prior to this invention, such microbeads have not been used as a dry lubricant between layers of plastic such as layers 17 and 19 in the mattress pad 1. Glass microbeads sold by 3M under the designation B-37 can be used. Such microbeads have an isostatic compressive strength of about 2,000 psi and are unbreakable in use in the present invention.

Figure 4:
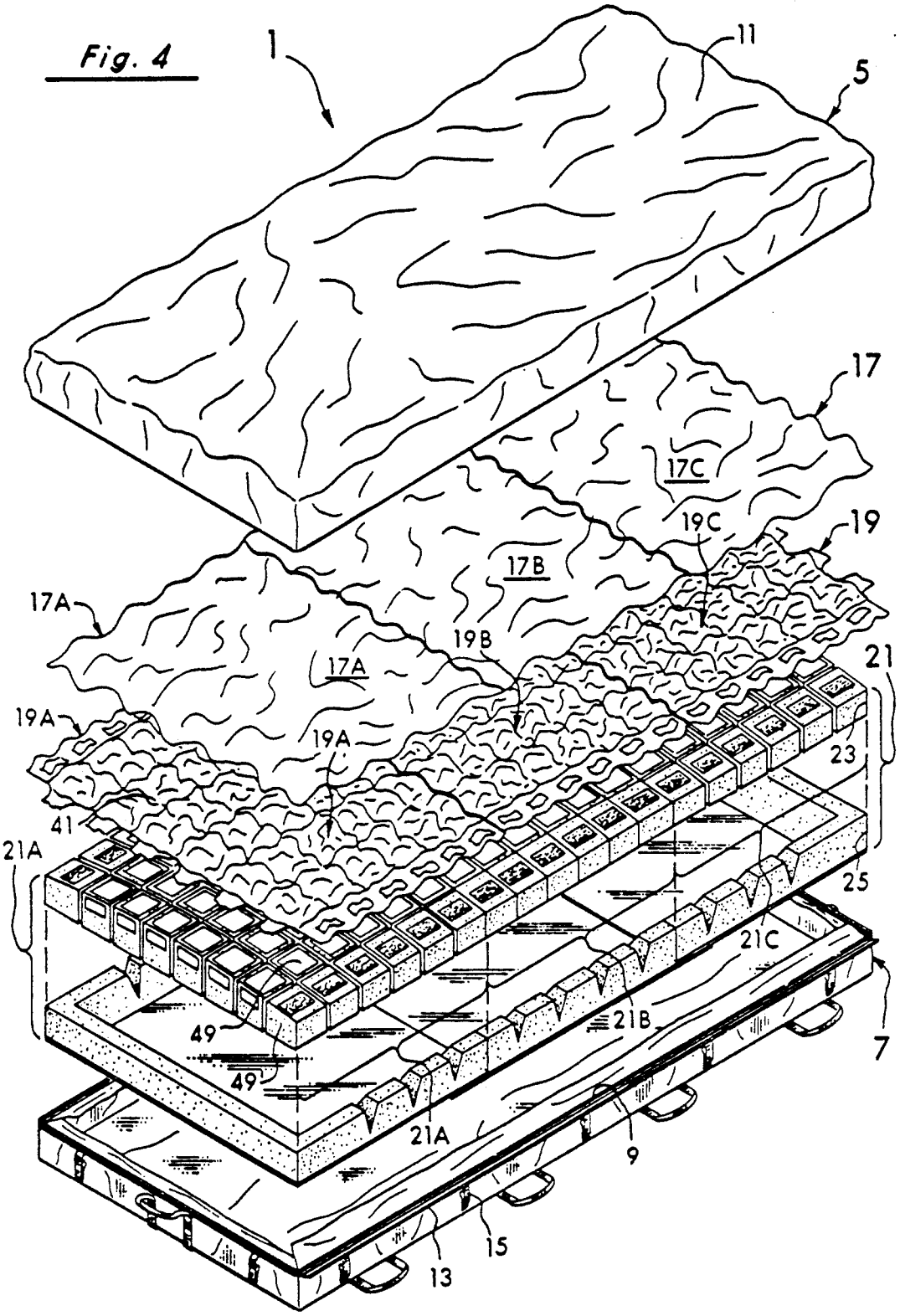
FIG. 4 is an exploded view of the mattress pad.
Figure 5:
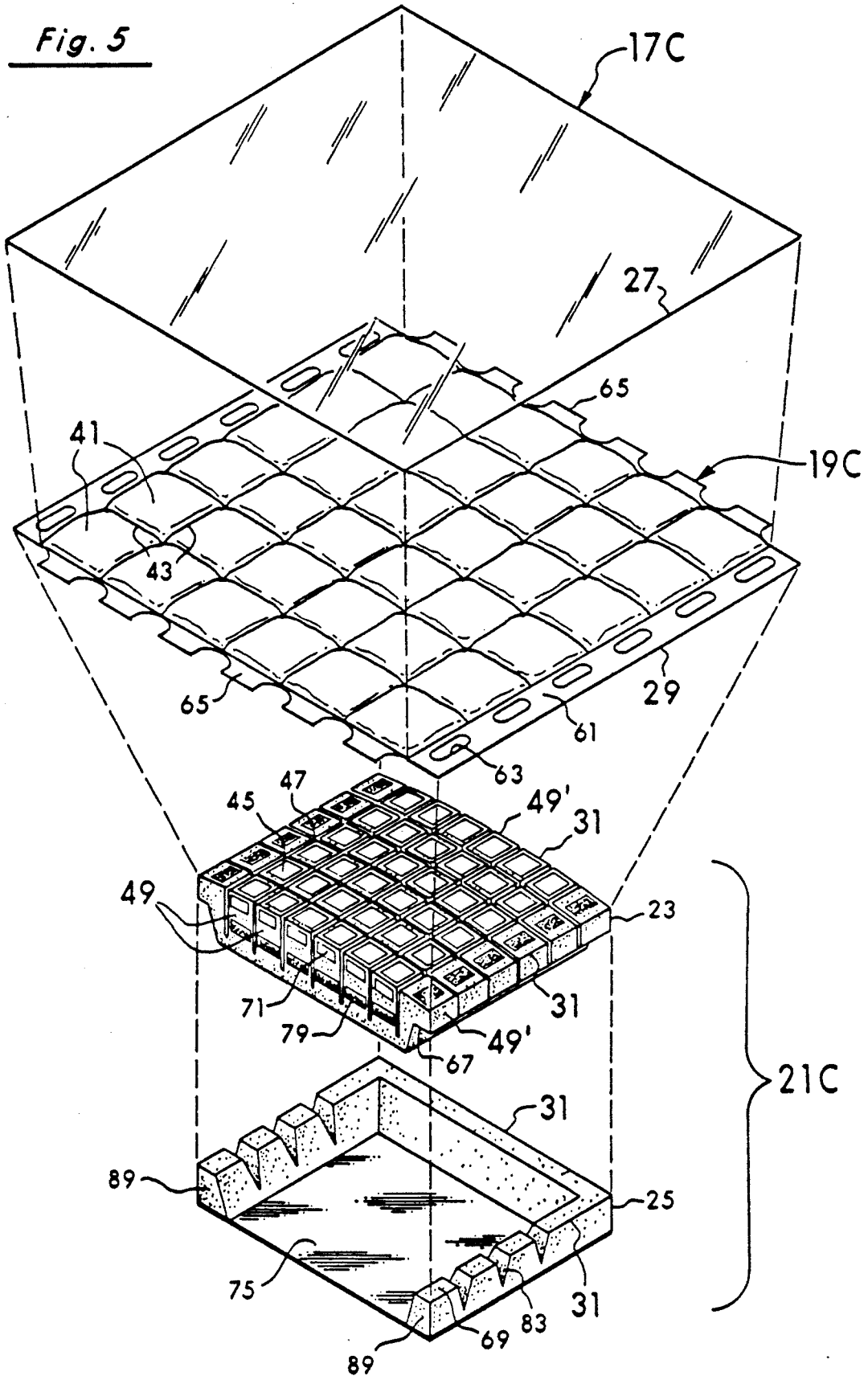
FIG. 5 is an exploded view of the plastic film layer, fluid bladder layer, and foam layer of the head section of the mattress pad.

Referring again to FIG. 4 and more specifically to the enlarged view in FIG. 5 of the head section and its layers 17C, 19C, and 21C, the upper plastic film layer 17C and fluid bladder layer 19C are oversized relative to the underlying foam layer 21C. This simply means that prior to the layers 17C and 19C being secured to each other and to the foam layer 21C, they normally occupy areas substantially larger than (e.g., four times as large as) the area of the foam layer 21C to which they will ultimately be secured. This relative sizing is best illustrated in FIG. 5 wherein the areas of layers 17C and 19C bounded by the respective boundary perimeters 27 and 29 are shown as being about four times the size of the area enclosed by the boundary perimeter 31 of the underlying foam layer 21C. In this regard, both the width and length of layers 17C and 19C are about twice the corresponding width and length of layer 21C so that the oversizing is essentially in all directions. This oversizing relationship is also illustrated in the plan view of FIG. 6 with just the fluid bladder layer 19C and the underlying foam layer 21C shown for clarity. Referring again to FIG. 5, the upper layer 17C of plastic film is sealingly secured at its boundary perimeter 27 to the underlying, fluid bladder layer 19C adjacent to the boundary perimeter 29 of the layer 19C. In this regard as shown in FIG. 5, the bounded perimeter areas of the layers 17C and 19C are substantially the same. However, when secured to the underlying foam layer 21C (see FIG. 7), the oversized layers 17C and 19C lie relatively loose and bunched atop layer 21C. This same oversizing is also provided for the upper half 5 of the outer cover or casing for the mattress pad 1 as well as any other topping layers such as the hospital sheet 11. In this manner (as explained in more detail below), layers 17C, 19C, and 21C can be depressed under the weight of the patient without drawing either of the layers 17C or 19C taut like a hammock. Within the sealed perimeter boundaries at 27 of layers 17C and 19C, the microbeads are positioned (e.g., through a syringe inserted through layer 17C) to dramatically reduce the lateral shearing forces or frictional drag between layers 17C and 19C. This, in turn, markedly reduces the possibility that decubitus ulcers will be developed by the patient.

Figure 8:
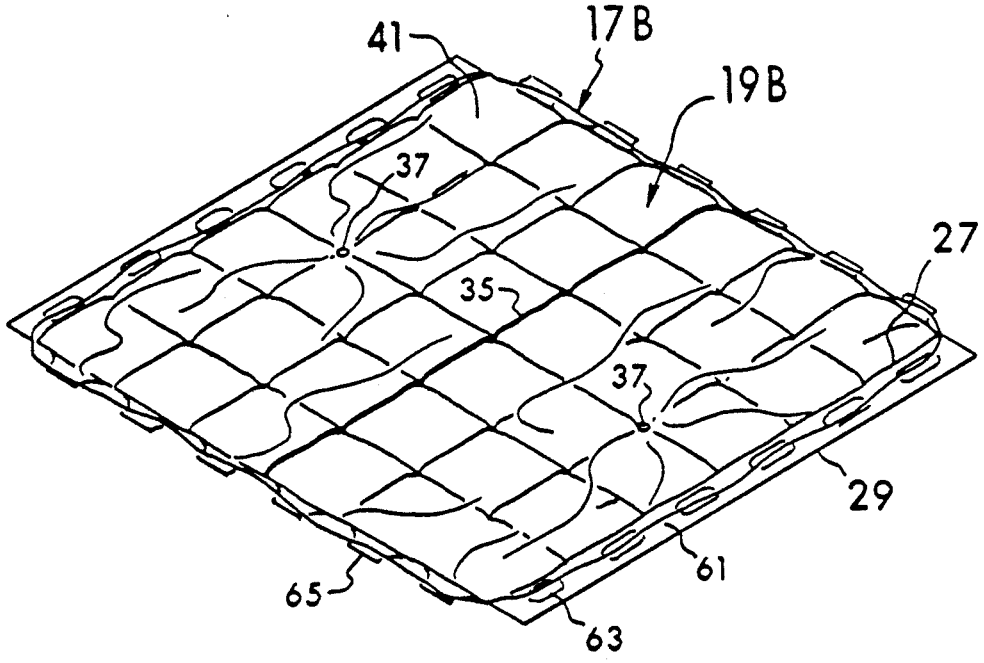
FIG. 8 is a view of the plastic film layer and fluid bladder layer of the middle section of the mattress pad showing the plastic layer attached along a central seam and several spots to the underlying fluid bladder layer.

In the foot and head sections of the mattress pad 1, each set of layers 17A and 19A in the foot section and layers 17C and 19C in the head section is similarly secured and sealed together about and adjacent their respective boundary perimeters. This then forms essentially one large, sealed pocket respectively between layers 17A and 19A in the foot section and between layers 17C and 19C in the head section to maintain the microbeads with layers 17A and 17C somewhat billowing atop the respective layers 19A and 19C. However, in the middle section of layers 17B and 19B (see FIG. 8), additional attachments of these layers to each other within their sealed perimeter boundaries about 27 may be desirable to limit the relative sliding movement (i.e., stroke) between them. That is, the middle section generally supports the parts of the patient's body bearing the most weight (e.g., lower back, buttocks, and upper thighs). Consequently, in this middle section, it may be desirable to limit or control the degree or distance of the relative sliding movement (i.e., stroke) between layers 17 and 19 lest the patient move too much on the pad 1 as for example, when the head or other parts of the mattress pad 1 are elevated. To accomplish this control, the middle section may have, for example, an additional seam 35 extending longitudinally down its middle between sealed boundary portions of the layers 17B and 19B (see FIG. 8). The linear seam 35 may then create two sealed pockets between the layers 17B and 19B extending on either side of the seam 35. Further, the layers 17B and 19B can be spot sealed or otherwise attached to each other at 37 in FIG. 8. This then also serves to limit or control the relative sliding movement between layers 17B and 19B within their sealed boundaries about 27 as will be most beneficial to the patient's comfort and safety.

Normal Pressures—Fluid Bladder Layer And Underlying Foam Layer

Normal pressures and reaction forces on the patient's body are reduced and minimized primarily by the fluid bladder layer 19 and the underlying foam layer 21.

Figure 6:
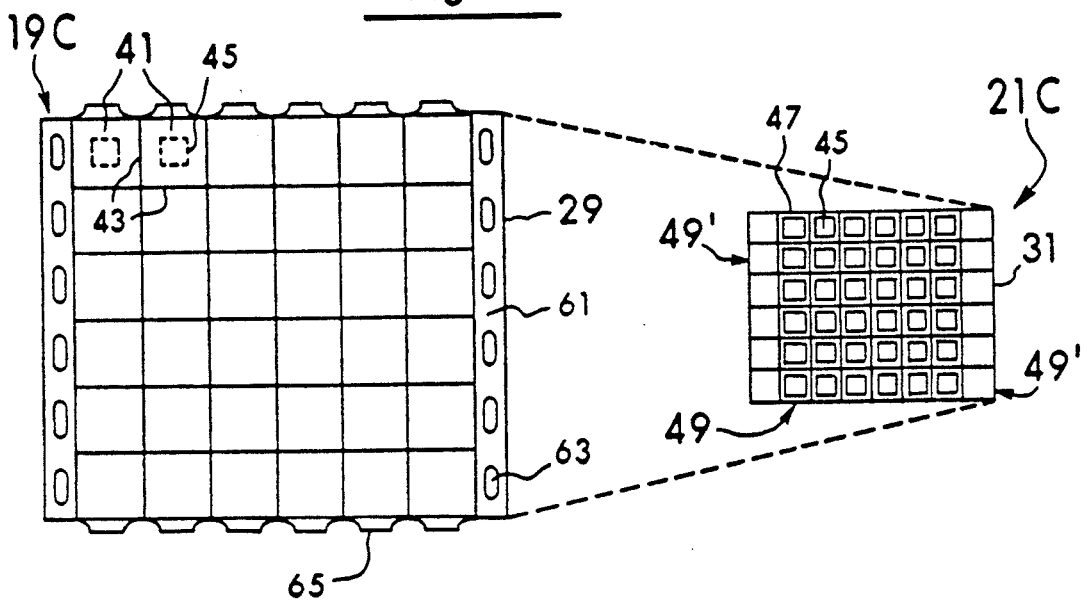
FIG. 6 is a plan view showing the oversizing of the fluid bladder layer relative to its underlying foam layer.
Figure 7:
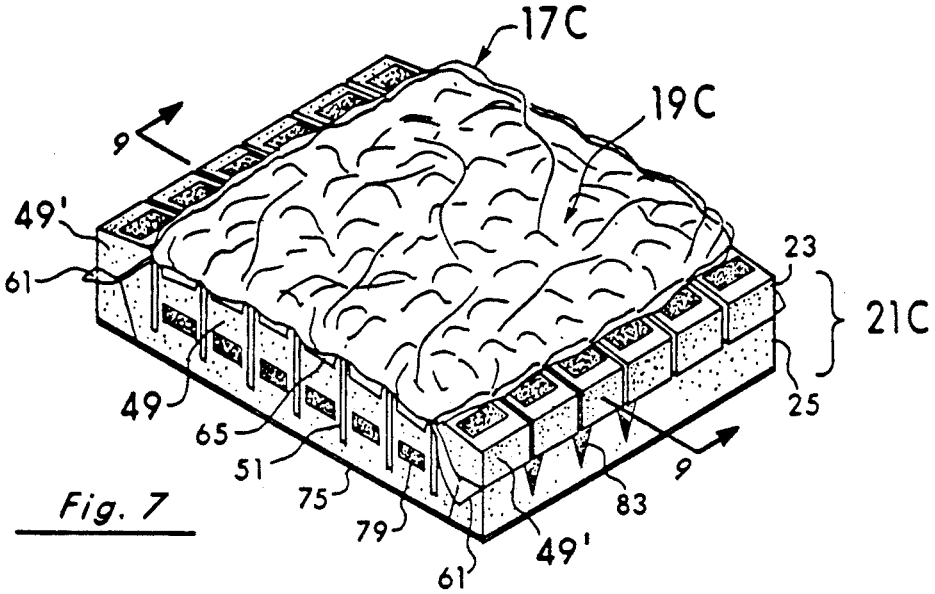
FIG. 7 is an assembled view of the exploded head section of FIG. 5.

The fluid bladder layer 19 of the present invention preferably has a plurality of discrete pouches 41 (see FIGS. 5 and 6). Each pouch 41 has a sealed perimeter 43 (see FIG. 6) and is attached by patches of two-faced adhesive tape 45 to the upper surface 47 of the corresponding foam column 49 or 49' (see also FIG. 5). Each pouch 41 is oversized relative to the corresponding upper surface 47 of the interior foam column 49 or the perimeter foam column 49' to which it is attached. In this regard, the bounded area of the pouch 41 within its perimeter seal 43 is about four times the area of the upper surface 47 of the foam column 49 or 49' to which it is attached. As was the case with layers 17 and 19, both the width and length of each pouch 41 are about twice the corresponding width and length of the upper surface 47. In this manner and with each pouch 41 essentially centered on the corresponding upper surface 47 of the corresponding foam column 49 or 49', portions of the oversized bladder pouches 41 including the seams 43 between adjacent pouches 41 can extend downwardly into the gaps 51 between adjacent foam columns 49 (see the middle of FIG. 9). In this preferred manner, seams 43 are essentially tucked out of the way from the patient on the pad 1 so as not to present any unnecessary pressure points (e.g., due to the lack of a fluid cushioning layer). The same is true for the central seam 35 and spot seals 37 of the layer 17B in FIG. 8 wherein they are aligned and positioned with the pouch seams 43 and can also be tucked into the gaps 51 between columns 49.

The fluid bladder layer 19 preferably is made of three plastic films or strata with the fluid pouches 41 formed between the top two films and the adhesive patch 45 attached to the bottom, third film. Among other things, the bottom, third film offers an additional film of protection against possible breakage or puncture of the sealed pouches 41.

The fluid within the bladder pouches 41 is preferably a highly viscous liquid such as a plastic or viscous thixotropic material which flows gradually when pressure is applied to it but which maintains its shape and position in the absence of pressure. One such fluid having the desired non-resilient, non-restoring viscous properties is commercially available under the trademark "FLO-LITE" of Alden Laboratories. Other suitable flowable materials are set forth and identified in U.S. Pat. No. 4,588,229. In most cases, the preferred fluid is a liquid with a viscosity greater than the viscosity of water and with a density less than that of water in addition to exhibiting the above-mentioned thixotropic properties. However, in some applications, the fluid could be air, water, or oil as well as water-based or oil-based compounds if desired.

The foam layer 21 as discussed above and illustrated in FIGS. 4 and 5 has a resilient, soft foam 23 centrally positioned in and supported by a perimeter support member 25 made of a more rigid foam. The resilient, soft foam 23 is cut as shown into a plurality of discrete spring elements of upstanding, interior foam columns 49 and perimeter foam columns 49' (see FIG. 5) which correspond in number and relative positioning to the pouches 41 of the fluid bladder layer 19 to which they are attached. With each pouch 41 so attached, the relative sliding or lateral movement is then preferably greater between layers 17 and 19 than between layers 19 and 21. The foam columns 49 may be solid or have hollowed-out cores such as 53 and 53' in FIG. 9, which cores can be varied in size (e.g., height, volume) and shape (e.g., cylindrical, conical) to vary the spring characteristics of the individual foam columns 49. These spring characteristics can also be controlled in the present invention by varying the size or width of the gaps 51 between the foam columns 49 (see FIGS. 9 and 11) as well as varying the number and depths of the cuts forming the gaps 51.

In use, the preferred spring characteristic of the foam columns 49 is that they will offer a uniform reaction force and pressure regardless of the amount of depression or displacement downwardly of the foam columns 49. That is, the desired spring characteristic is non-linear in that the reaction force of each column 49 is preferably, substantially the same over the normal deflection range incurred when a patient is on the mattress pad 1 of the present invention. The result is that each part of the patient's body is supported by substantially the same pressure regardless of the amount of depression or displacement of each of the foam columns 49. The resulting pressure is then preferably designed to be below that pressure at which capillary blood flow is blocked or occluded (e.g., about 30 millimeters of mercury). To this aim, the foam columns 49 are hollowed-out to varying degrees (or not hollowed-out) and their gap spacings and depths varied in accordance with their relative positioning in the pad 1 (e.g., head, hip, or heel area). This is done to create the desired stiffness gradients along and across the mattress pad 1 primarily in accordance with the anticipated loading pattern by the patient's body. In adjusting the widths of gaps 51, the preferred manner is to substantially align the gaps 51 longitudinally from section to section and then to simply make the widths of the cuts vary. The result is that some columns 49 will have upper surfaces 47 on their free standing, upper end portions with smaller areas than others (e.g., 4 inches by 4 inches versus 4½ inches by 4½ inches). Similarly, since the sides of the foam columns 49 are preferably vertical, the attached or interconnected bases of the columns will also vary in size. However, the gaps 51 will still be longitudinally aligned. The preferred shapes of the upper surfaces 47 (and fluid bladder pouches 41) are square but they can be other shapes (e.g., rectangular) if desired.

Figure 10:
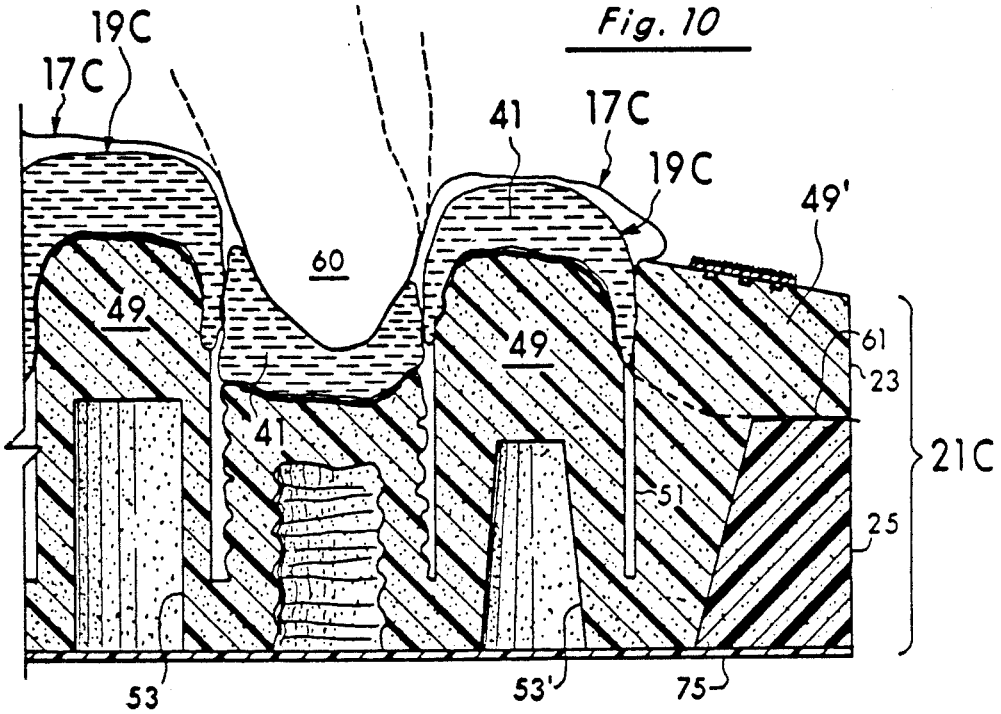
FIG. 10 is an enlarged view of the right side of FIG. 9 showing the operation of the mattress pad to receive and support a protruding bony area (i.e., elbow) of a patient.

In operation, the desired result of the oversizing of layers 17 and 19 on foam layer 21 and of the control of the spring characteristics of the foam columns 49 is illustrated in FIG. 10. As shown, each foam column 49 when loaded axially can deflect downwardly independently of all adjacent columns 49 allowing the attached fluid bladder pouch 41 to conform to irregular body shapes (e.g., the illustrated elbow 60) without bottoming out and without drawing the layers 17C and 19C taut like a hammock. This in turn results in the mattress pad 1 of the present invention supporting all parts of the patient's body with substantially the same, relatively low pressure with few if any localized pressure points. Coupled with the use of the microbeads between the layers 17 and 19, the mattress pad 1 of the present invention then offers not only minimized normal pressures and forces on the patient's body but also greatly minimized lateral shearing forces. The operation of the pad 1 thus favorably compares with much more expensive and complex specialty beds in the prevention and cure of decubitus ulcers in patients using the pad 1.

In further regard to the longitudinal sectioning of the pad 1 and as discussed above, each layer 17, 19, and 21 is preferably sectionalized longitudinally into foot, middle, and head sections. This is done primarily for ease of handling, shipping, and storage as the fluid bladder layers 19A, 19B, and 19C can weigh up to about 40 pounds each. In securing the fluid bladder layer 19 to the underlying foam layer 21, each bladder pouch 41 is centered atop a corresponding foam column 49 or 49' and attached thereto by two-faced adhesive patches 45 or other means including removable fastening means such as hook and loop ones (e.g., Velcro). Additionally, the fluid bladder layer 19 is secured about its perimeter boundary 29 to the underlying foam layer 21. As shown in FIG. 5, the longitudinal sides 61 of the fluid bladder layer 19C have a series of holes or loops 63 therealong. The remaining two sides extending across the width of the layer 19C have spaced tabs 65 therealong. In assembly, the loops 63 correspond in number and relative spacing to the outer, perimeter foam columns 49' on the sides and are looped over the respective outer columns 49' (see FIGS. 5 and 7) to secure the longitudinal sides 61 of the layer 17C to the outer columns 49'. In doing so, the outer columns 49' of soft foam 23 are simply squeezed or compressed to pass through the loops 63. The longitudinal sides 61 of the fluid bladder layer 19C (see FIG. 9) are then sandwiched between the lower surfaces 67 of the outer columns 49' of soft foam 23 and the upper surfaces 69 of the more rigid foam 25. Once so positioned, the assembly can simply be glued together to secure the various pieces in place. The remaining two sides extending across the longitudinal axis of the fluid bladder layer 19C (see FIG. 5) are then secured to the underlying foam layer 21C by attaching the depending tabs 65 to the outer rows of foam columns on each end. This can be done by providing the depending tabs 65 with two-faced adhesive patches and then respectively securing them to the corresponding adhesive patches 71 of the foam columns (i.e., foam columns 49 on the near side in FIG. 5 and perimeter foam columns 49' on the far side). Such attachments like all other attachments in the present invention could be removable ones (e.g., hook and loop fasteners) if desired. Alternatively, the layers 19 and 21 can simply be secured and held together substantially about and adjacent their boundary perimeters by the adhesive patches or other fastening means 45 between the pouches and columns without using any additional arrangements like loops 63 or tabs 65.

Figure 11:
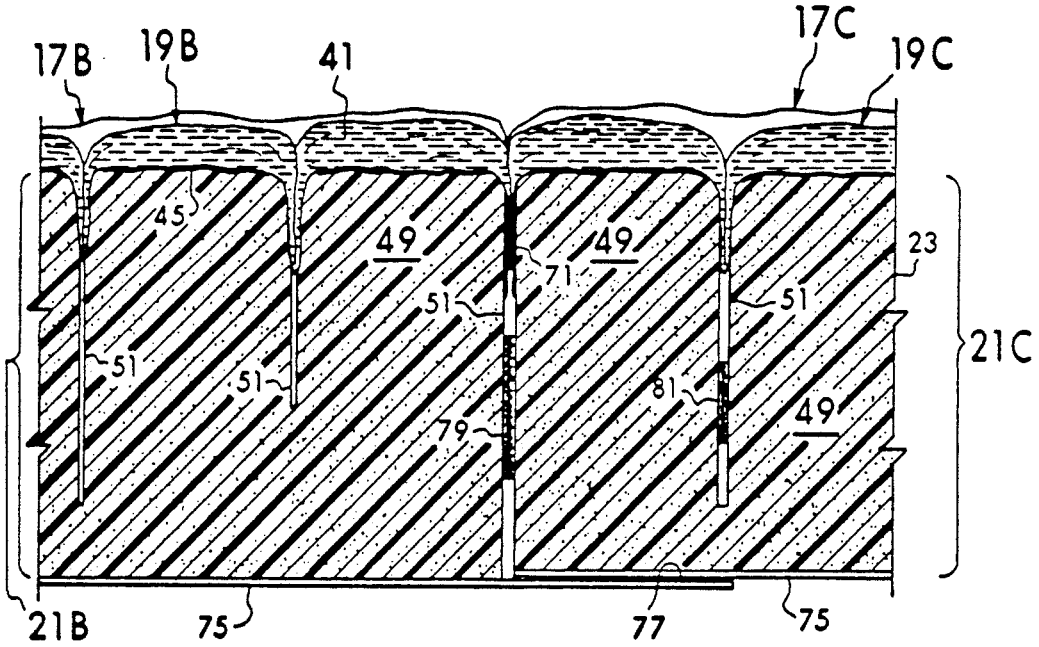
FIG. 11 is an enlarged cross-sectional view of the interface between the middle and head sections of the mattress pad.

Adjacent sections (e.g., head and middle sections) of the pad 1 are preferably linked together as shown in FIG. 11. As illustrated in FIG. 11, foam layer 21B of the middle section preferably has an extension of its stiff, lower backing member 75 that runs underneath the corresponding backing member 75 of the head section. The overlapping portions of members 75 are then preferably secured to each other by hook and loop fasteners such as Velcro strips 77 or any other removable fastening arrangement. Additionally, the adjacent, end columns 49 of the respective middle and head sections are also preferably secured together with Velcro strips 79 as shown in FIG. 11. The attaching Velcro strips 79 between the columns 49 of the middle and head sections not only help to tie the two sections together but also serve to substantially match the spring characteristics of the attached foam columns 49 by making the effective depth of the gap 51 between them extend only down to the top of the attached Velcro strips 79.

As also shown in FIG. 11, adjacent foam columns 49 within the same section (e.g., the head section at 21C on the right in FIG. 11) can similarly have their spring characteristics adjusted and tied together. This can be done by simply providing and securing Velcro strips 81 between adjacent columns 49 within the same section at a distance less than the full depth of the cut gap 51 between the adjacent columns 49. The vertical locations or placements of the Velcro strips in the gaps 51 can also vary. For example, one pair of adjacent foam columns may be attached with their adjacent side walls substantially abutting relatively high in the gap 51 between them and another pair attached relatively low in the gap 51 between them. Such tying or attaching of the vertical sides of adjacent columns 49 by a structural connection such as 81 offers the additional advantage that when appropriate, the pressure reduction characteristics of the foam columns as discussed above can be reversed or increased in specific areas where increased tissue pressure on the patient may be desirable. That is, in some cases, it may be more desirable to have uneven normal pressures and, in fact, localized pressure points under parts of a specific patient's body that can stand the higher pressures. Such localized pressure points will then allow redistributing of the total patient load on the pad 1 wherein other areas of the patient's body with, for example, a burn can be supported by localized lower pressures. Such tying of adjacent columns 49 can also reverse or reduce the independent operation of each foam column by joining them together to share a particular load where desirable for a particular patient.

Figure 9:
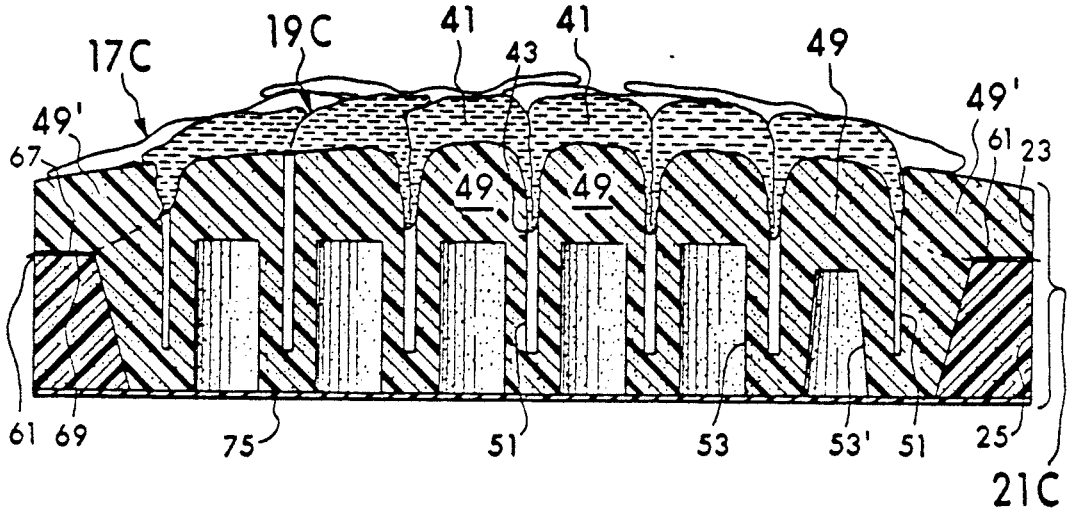
FIG. 9 is a cross-sectional view taken along line 9—9 of FIG. 7.

FIGS. 1, 2, 4, 5, and 7 and in particular, FIG. 9 illustrate a feature of the present invention in which the mattress pad 1 is provided with a crown down its longitudinal centerline. In this respect, the overall heights of the foam columns 49 and 49' increase or rise from the sides or perimeter columns 49' inwardly toward the longitudinal axis or centerline of the pad 1. This convex, crowning feature promotes the side-to-side mobility of the patient by creating a downward slope from the longitudinal centerline of the mattress 1 to the edge perimeters. The crowned contour facilities patient transfers to and from the mattress because the perimeter edge of the mattress 1 is lower and more accessible (e.g., from gurneys) while the center of the mattress 1 is at full thickness to allow maximum conformity and immersion of the patient. Also, in this regard, the positioning of the specially designed, perimeter columns 49' atop the rigid foam support 25 offers a firm area for a stable transfer to and from the pad 1.

Figure 12:
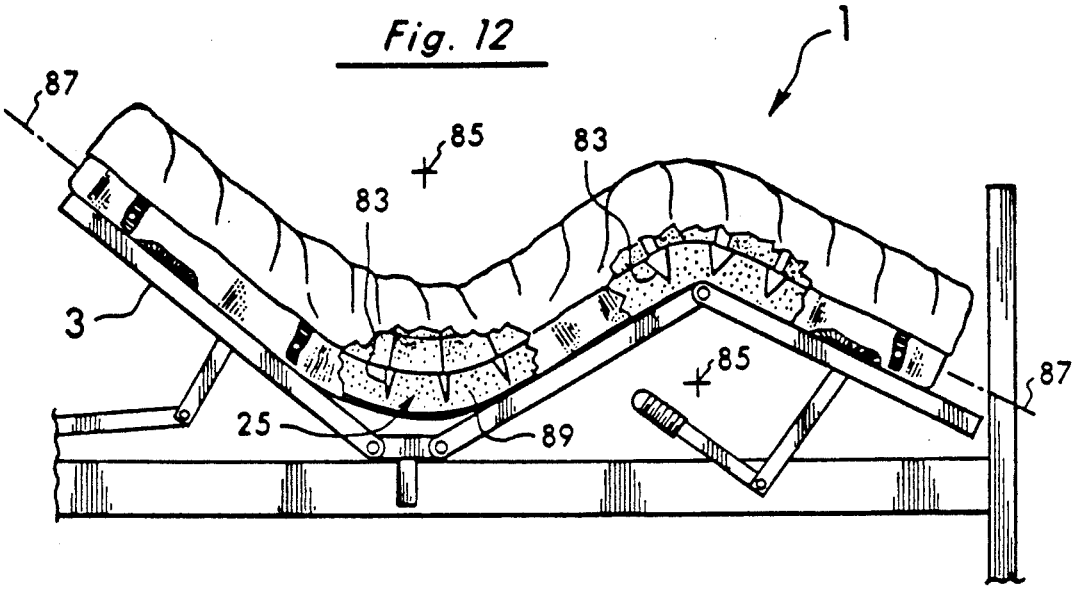
FIG. 12 illustrates the operation of the V-shaped cutouts or notches in the underlying foam layer to facilitate the flexure of the mattress pad on the hospital bed frame.

FIG. 12 illustrates the manner in which the V-shaped cutouts or notches 83 facilitate the flexure of the pad 1 about axes such as 85 which are perpendicular to the longitudinal axis 87 of the pad 1. The V-shaped notches 83 (see FIG. 5) are cut in the side portions 89 of the relatively rigid foam 25 (e.g., closed cell, cross-linked polyethylene) that provides the peripheral support to the inner, soft foam 23 (e.g., open-celled polyurethane). These side portions 89 as shown are spaced from each other and extend along the central axis of the pad 1. In operation, the notches 83 selectively open and close to varying degrees as shown in FIG. 12 to accommodate changes in the mattress pad 1 as for example, when the head and knee portions of the pad 1 are elevated.

Figure 13:
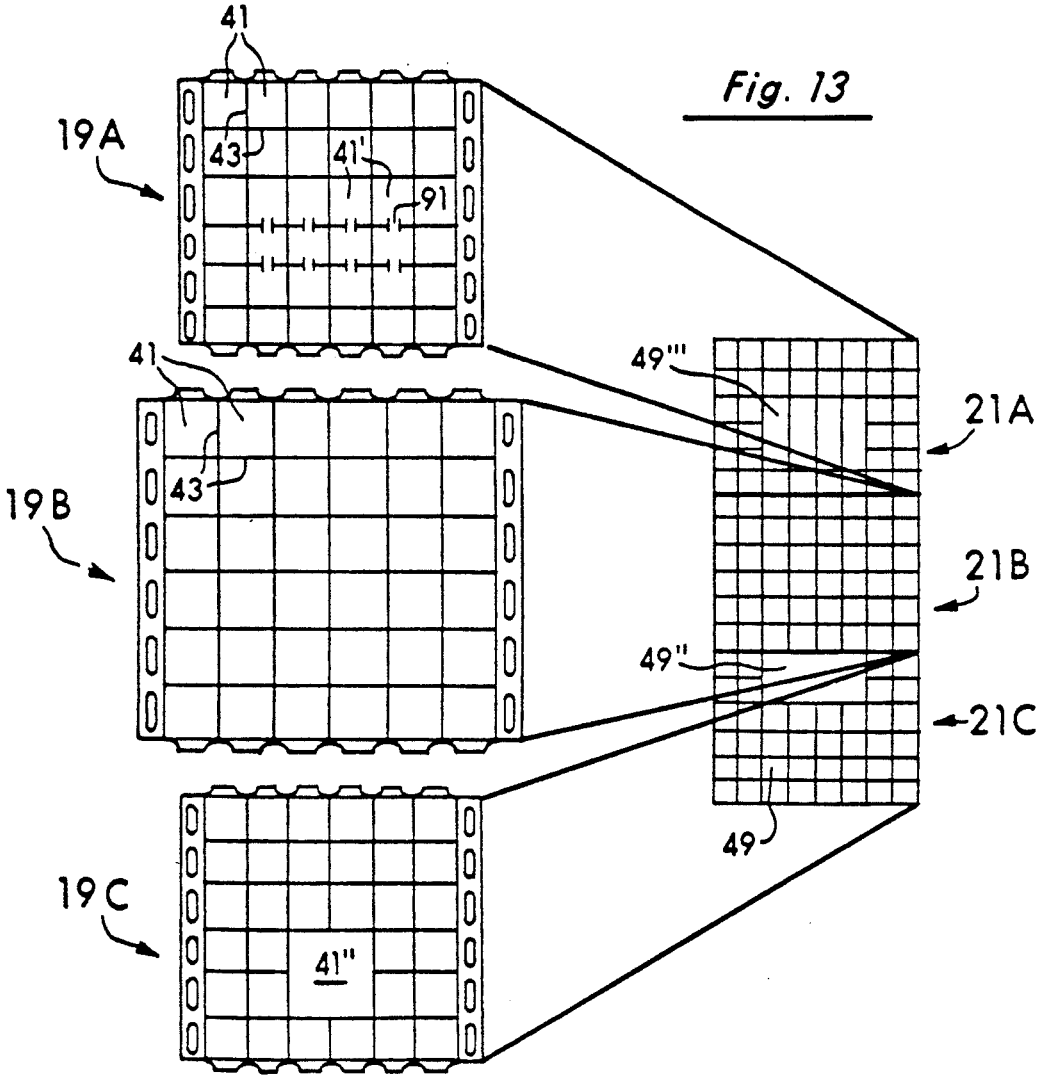
FIG. 13 is a plan view similar to FIG. 6 illustrating optional oversizing relationships between the fluid bladder layers and the foam layers of the foot, middle, and head sections of the mattress pad.

The head, middle, and foot sections of the fluid bladder layer 19 can also be constructed as illustrated in FIG. 13 to modify the various properties from section to section. As shown in FIG. 13, the fluid bladder layers 19A, 19B, and 19C are oversized to varying degrees relative to their underlying foam layers 21A, 21B, and 21C. In this regard, the sections bearing the lesser patient loads (e.g., foot and head) can have fluid bladders with areas oversized only about one and a half times the underlying foam areas. Additionally, the fluid bladder pouches 41 in the foot and head sections can be smaller and/or filled to lesser degrees to save on weight and cost. For example, the pouches 41 of the middle fluid bladder layer 19B are preferably filled to about 50% of volume or fill capacity whereas the pouches 41 of the foot and head bladders may be filled to lesser degrees (e.g., 25% of fill capacity). They may also be left empty and not filled at all depending upon their location and the intended application of the pad. With such ability to vary the sizes of the pouches 41 as well as the volume and percent of fluid fill, the pad of the present invention can be modified and customized to a great extent.

The pouches 41 can be formed in any number of manners including continuous heat seals as shown, stitching, or combinations of heat sealing and stitching. For ease of manufacture and assembly, the head and foot sections can be identical if desired. The plastics of the layers 17 and 19 are preferably extruded films (e.g., 3–10 thousandths of an inch thick) of polyurethane which are permeable to moisture (e.g., water) vapor but they can be impervious to moisture vapor if desired. The upper half 5 of the outer cover or casing of the mattress pad 1 can also be made of extruded polyurethane which is preferably pervious to moisture vapor as is the open-celled, non-rigid, polyurethane foam 23. In this manner, the accumulation of perspiration and other bodily fluids from the patient can be reduced to lower the possibility of skin breakdown or maceration that may lead to the development of decubitus ulcers. The peripheral support foam 25 of closed cell polyethylene foam is preferably impervious to moisture vapor as is the stiff, backing sheet 75 of high density polyethylene.

As discussed above, the design flexibility of the present invention enables the pad 1 and its components to be specially adapted to certain patients and applications. For example, as illustrated in FIG. 13, adjacent pouches 41' as shown in the foot section 19A may be interconnected by channels 91. Such channels 91 permit the fluid to pass or flow from one pouch to another. In the section 19A, these interconnected pouches 41' might be for example in the calf area. The patient's calf would then be allowed to immerse in the pouch or pouches 41' directly under it to a large degree displacing fluid into the longitudinally adjacent pouches 41' under the ankle and knee. The effect would be to more uniformly support the entire ankle-calf-knee area and reduce the normal support pressure in this interconnected area. Variations in the sizing of the pouches and/or underlying foam columns from section to section or within a section may also be desirable. For example, the fluid bladder layer 19C at the head section may have an enlarged pouch 41'' supported on a plurality (e.g., four) of underlying foam columns 49 of the layer 21C. The fluid bladder layer 19C may also have a plurality of pouches 41 (e.g., in the lumbar to upper back area) supported on one large foam column 49'' of the underlying layer 21C. Additionally, the interconnected pouches 41' discussed above in the foot section may be respectively supported on corresponding, elongated foam columns 49'''.

Figure 14:
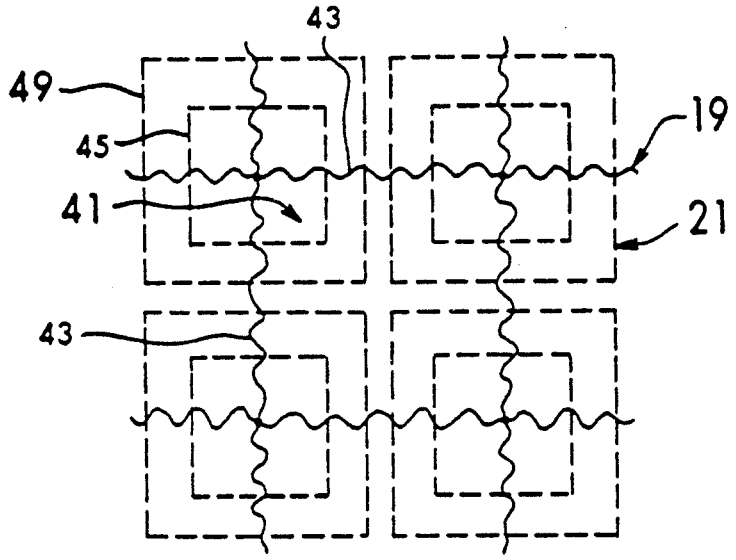
FIG. 14 illustrates an alternate placement of the fluid bladder layer relative to the underlying foam columns.

FIG. 14 illustrates an alternate mounting relationship of the fluid bladder 19 on the underlying foam columns 49. In contrast to the preferred alignment of FIGS. 5 and 6 with each pouch 41 centered atop the corresponding foam column 49, the pouches 41 in FIG. 14 are attached adjacent the seam juncture of four pouches 41. Each foam column 49 is then attached to four pouches 41. Similarly, each pouch 41 is attached to four columns 49. Other off-center or asymmetrical attachments could also be made as well as arrangements in which only certain pouches 41 and columns 49 were attached while others were not. However, a one-to-one attachment of each pouch and column in the alignment relationship of FIGS. 4 and 5 is preferred.

Figure 15:
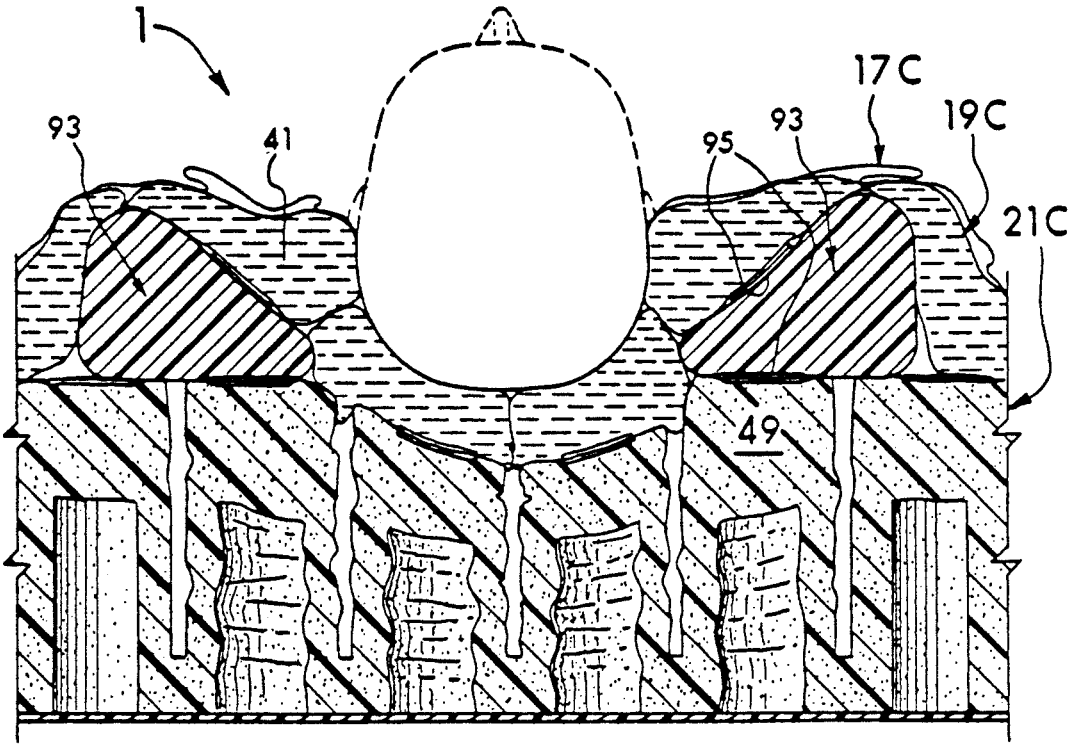
FIG. 15 illustrates the use of the pad of the present additional, anatomically shaped supports positioned between the fluid bladder layer and the underlying foam layer.
Figure 16:
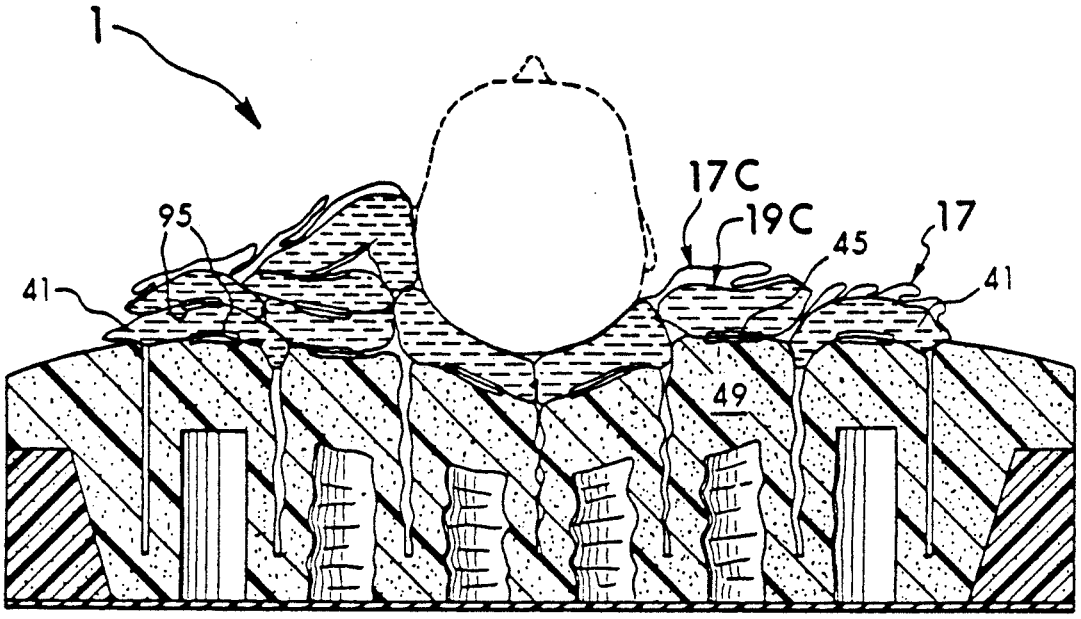
FIG. 16 illustrates the use of the present invention with separate, individual fluid pouches and with the fluid bladder layer bunched up on one side to provide further support to the patient.

The versatility and adaptability of the present invention is further illustrated in FIGS. 15 and 16. In FIG. 15, the present invention is shown in use in conjunction with an operating table in which the patient's head, for example, is being positioned for surgery. In such use, the pad 1 offers the pressure relief, stability, and immobilization needed to be achieved simultaneously in such applications. This can be further enhanced by providing substantially rigid, foam supports or inserts 93 which can be positioned and removably attached at 95 between the fluid bladder layer 19C and the underlying foam layer 21C. The wedges or supports 93 are anatomically shaped and in this manner, the patient's head (or other body part) can be firmly and relatively comfortably supported in the desired position during the surgery period which can easily last for several hours.

Another unique adaptation of the present invention is illustrated in FIG. 16. In it, the pad 1 is shown as being bunched up on the left side of FIG. 16 to add support and comfort to the patient as he lies in the position shown. In this regard, each fluid pouch 41 is removably attached at 45 to its underlying foam column 49 by a hook and loop fastener (e.g., Velcro) or any other removable fastening means. Each pouch 41 then can be disengaged from its support 49 and the fluid bladder layer 19 bunched up on itself as illustrated and reattached in place. The use of such removable fastening means 45 is equally applicable to all of the other embodiments of the present invention. The fluid bladder layer 19 of the present invention is preferably made up of a plurality of discrete pouches 41 that are attached to each other along their seams 43. However, as illustrated by pouch 41 on the far right side of FIG. 16, the discrete pouches 41 in all of the embodiments of the present invention can be separated from each other and individually attached to the foam column 49. Additionally, as shown, such separate pouches 41 can have their own plastic film layer 17 on top of them. Also, certain of these separate pouches 41 can be provided with removably attachable fasteners 95 on both of their upper and lower surfaces and used for example as an insert beneath the main fluid bladder layer 19 as shown on the far left side in FIG. 16. Such additional pouches can be inserted anywhere under the main bladder to add even more versatility and adaptability to the pad 1.

While several embodiments of the invention have been shown and described in detail, it is to be understood that various modifications and changes could be made to them without departing from the scope of the invention. For example, although the present invention is shown and described primarily as a mattress pad, it is equally adaptable for other applications such as single cushions and seat or back pads. Also, the underlying layer 21 has been shown and described primarily as being made of foam but in many applications, the improvements of the present invention could be equally adapted for use with pneumatic, liquid, or coil spring designs.

We claim:

1. A pad primarily intended for use as a hospital mattress to reduce the development of decubitus ulcers in patients using the pad, said pad including:

a first layer having a plurality of discrete spring elements, said spring elements being upstanding columns having free standing, upper end portions and being made of resilient foam wherein adjacent pairs of said spring elements have vertically extending gaps therebetween spacing said adjacent pairs apart and said spacing varies between respective pairs of said spring elements to vary the spring characteristics of said upstanding foam columns, each of said upstanding foam columns having a base and a free standing, upper end portion with an upper surface and sides extending between the base and upper surface of each foam column, said pad further including means to attach together side walls of adjacent columns at a locations along said side walls between the based and upper surfaces of the adjacent foam columns to vary the spring characteristics of said attached, adjacent foam columns.

2. The mattress pad of claim 1 wherein said attaching means attaches pairs of adjacent foam columns together at varying vertical locations.

3. The mattress pad of claim 1 wherein said attaching means attaches said side walls together in a substantially abutting relationship at said location.

4. The mattress pad of claim 1 wherein bases of adjacent columns are attached to one another.

5. A pad primarily intended for use as a hospital mattress to reduce the development of decubitus ulcers in patients using the pad, said pad including:

a first layer having a plurality of discrete spring elements, each spring element being resilient and having a free standing, upper end portion with adjacent free standing, upper end portions of adjacent spring elements being separated with a vertically extending gap therebetween, said gap extending downwardly for a first distance and said pad further including means to attach said adjacent spring elements to each other across said gap at a location down the gap less than said first distance.

6. The mattress pad of claim 5 wherein said spring elements are upstanding columns made of foam.

7. The mattress pad of claim 6 wherein said upstanding foam columns have bases and the bases of said adjacent foam columns are attached to one another.

8. The mattress pad of claim 6 wherein said attaching means attaches pairs of adjacent foam columns together at varying vertical locations.

9. The mattress pad of claim 6 wherein said attaching means attaches said adjacent foam columns together in a substantially abutting relationship at said location.

10. The mattress pad of claim 6 wherein said upstanding columns have hollowed-out cores.

11. The mattress pad of claim 10 wherein said hollowed-out cores vary in size to create varying spring characteristics from one foam column to another.

12. The mattress pad of claim 11 wherein said hollowed-out cores vary in shape to create varying spring characteristics from one foam column to another.

13. The mattress pad of claim 10 wherein the spring characteristics of said upstanding foam columns are non-linear.

14. The mattress pad of claim 6 wherein each of said upstanding foam columns has a base.

15. The mattress pad of claim 14 wherein the bases of said foam columns vary in size.

16. The mattress pad of claim 14 wherein the upper surfaces of said foam columns vary in size.

17. The mattress pad of claim 14 wherein said foam columns have sides extending substantially vertically between the base and upper surface of each foam column wherein the spacing between side walls of adjacent columns varies.

18. The mattress pad of claim 5 wherein adjacent pairs of said spring elements have vertically extending gaps therebetween spacing said adjacent pairs apart and said spacing varies between respective pairs of said spring elements to vary the spring characteristics of said upstanding foam columns.

* * * * *